US006117029A

United States Patent [19]

Kunisaki et al.

[11] Patent Number: 6,117,029

[45] Date of Patent: Sep. 12, 2000

[54] HOCKEY STICK SHAFTS, HOCKEY STICKS, AND METHODS OF MAKING THEM

[76] Inventors: Ronald H. Kunisaki, 581 Calle Arroyo, Thousand Oaks, Calif. 91360; Kirk S. Oshinomi, 2257 W. 232nd St., Torrance, Calif. 90501; Thomas G. Wong, 9604 Weybridge Ct., Cypress, Calif. 90630

[21] Appl. No.: 09/042,694

[22] Filed: Mar. 17, 1998

Related U.S. Application Data

[60] Provisional application No. 60/039,203, Mar. 17, 1998.

[51] Int. Cl.[7] ..... A63B 59/14

[52] U.S. Cl. ..... 473/561; 473/562

[58] Field of Search ..... 473/560–567

[56] References Cited

U.S. PATENT DOCUMENTS 3,934,875 1/1976 Easton et al. .
4,505,479 3/1985 Souders .
4,836,545 6/1989 Pompa .
5,419,553 5/1995 Rodgors .
5,439,215 8/1995 Ratchford .
5,496,027 3/1996 Christian et al. .
5,605,327 2/1997 McCutchen .
5,607,154 3/1997 Meumann et al. .
5,655,981 8/1997 Reed ..... 473/560

*Primary Examiner*—Mark S. Graham
*Attorney, Agent, or Firm*—Arent Fox Kintner Plotkin Kahn

[57] ABSTRACT

A hockey stick shaft having a blade end and a remote end. The shaft is formed of a composite portion having a hollow structure including an interior surface and an exterior surface. The composite portion is formed from fibers and resin. A metallic tip is attached at least at a first edge at the blade end to a first tip surface of the metallic tip.

10 Claims, 3 Drawing Sheets

Fig.3
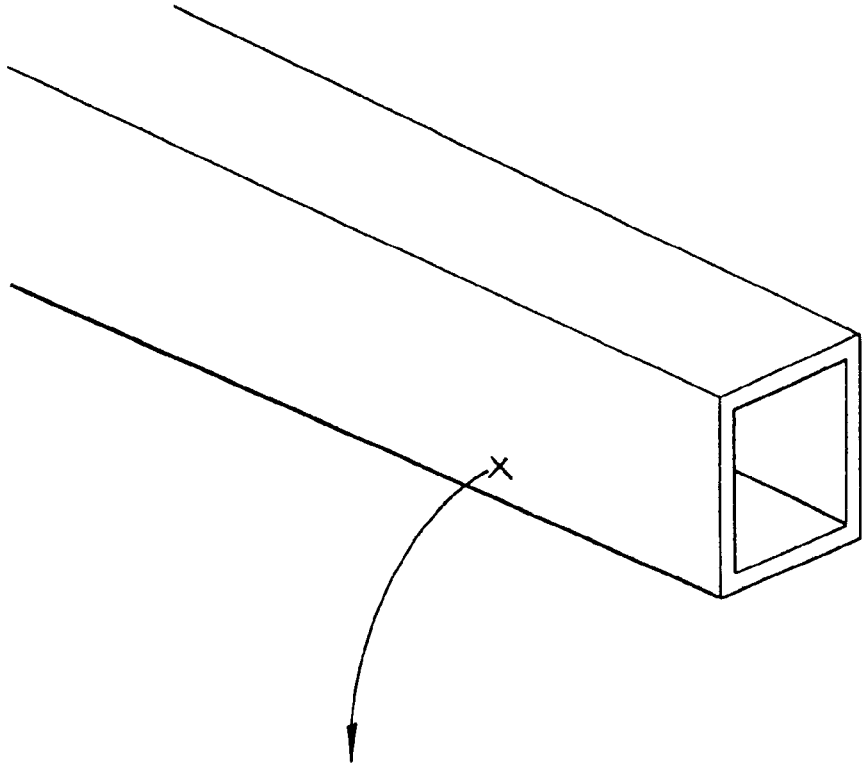
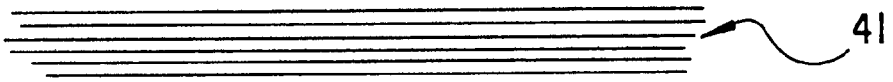
Fig.4

HOCKEY STICK SHAFTS, HOCKEY STICKS, AND METHODS OF MAKING THEM

This application claims priority of United States Provisional patent application Ser. No. 60/039,203, filed Mar. 17, 1998.

BACKGROUND OF THE INVENTION

1. Field of the Invention

The present invention is directed to shafts for hockey sticks and methods of making shafts for hockey sticks.

2. Background of the Invention

There is an ongoing need for improving various properties of hockey sticks. Such properties include the strength, stiffness, flexibility, damage tolerance, temperature resistance, vibration damping profile, and weight. Also, there is an ongoing need for improving various other characteristics of hockey sticks, as discussed herein.

SUMMARY OF THE INVENTION

In accordance with the present invention, there are provided improved methods of making hockey stick shafts and hockey sticks, as well as improved hockey stick shafts and improved hockey sticks.

Hockey stick shafts made of aluminum exhibit relatively low vibration damping, and so a great deal of impact energy is transferred to (and/or felt) by the player holding such a stick (e.g., particularly when the player takes a "slapshot"). Hockey stick shafts made of wood or polymeric materials exhibit temperature resistances which are generally lower than hockey stick shafts made of aluminum alloys. As a result, where heat is applied to a wooden or polymeric shaft in order to bond the blade portion of the hockey stick to the shaft, thermally induced damage can occur to the shaft. Aluminum alloys and wood typically have low yield strengths (or proportional limits), and so permanent deformation (bending) can occur when relatively low forces are applied.

The present invention provides a hockey stick shaft and a hockey stick, as well as methods for making them, which provide significant improvements over previously known shafts, sticks and methods, as discussed in more detail below.

In accordance with a first aspect of the present invention, there is provided a method of making a hockey stick shaft (and the hockey stick shaft formed thereby), comprising:

(a) forming a laminate comprising a plurality of layers, each of the plurality of layers comprising composite material comprising fibers and resin, the laminate having at least a first transverse edge and a second transverse edge;

(b) bringing into contact with the first transverse edge of the laminate a metallic tip having a first tip surface which contacts the first transverse edge; and (c) curing the resin, thereby bonding the plurality of layers to each other and bonding the first tip surface of metallic tip to the first transverse edge of the laminate.

In accordance with a second aspect of the present invention, there is provided a method of making a hockey stick shaft (and a hockey stick shaft formed thereby), comprising:

(a) forming a laminate comprising a plurality of layers, each of the plurality of layers comprising composite material comprising fibers and resin, the laminate having at least a first transverse edge and a second transverse edge;

(b) curing the resin; and (c) attaching a metallic tip to the first transverse edge.

In accordance with a third aspect of the present invention, there is provided a method of making a hockey stick shaft (and a hockey stick shaft formed thereby), comprising:

(a) forming a hollow laminate comprising a plurality of layers of composite material and at least one metallic layer, each of the plurality of layers of composite material comprising fibers and resin, the laminate having interior and exterior surfaces, at least a first transverse edge and a second transverse edge; and (b) curing the resin, thereby bonding the plurality of layers of composite material and at least one metallic layer to each other.

In accordance with a fourth aspect of the present invention, there is provided a hockey stick shaft comprising:

a composite portion having a hollow structure, the composite portion comprising an interior surface and an exterior surface, and at least a first edge, the composite portion comprising fibers and resin; and a metallic tip, the metallic tip having a first tip surface, the first edge of the composite portion being attached to the first tip surface of the metallic tip.

In accordance with a fifth aspect of the present invention, there is provided a hockey stick shaft comprising a hollow laminate comprising composite material and at least one metallic layer, the composite portion comprising fibers and resin.

The present invention is also directed to hockey sticks which include a hockey stick shaft as described herein, and to methods of making such hockey sticks.

BRIEF DESCRIPTION OF THE DRAWING FIGURES

FIG. 3 is a perspective view of a hockey stick shaft made in accordance with an embodiment of the third aspect of the present invention.

FIG. 4 is a cross-sectional view of one wall of a hockey stick shaft made in accordance with an embodiment of the third aspect of the present invention.

DETAILED DESCRIPTION OF THE INVENTION

Figure 1:
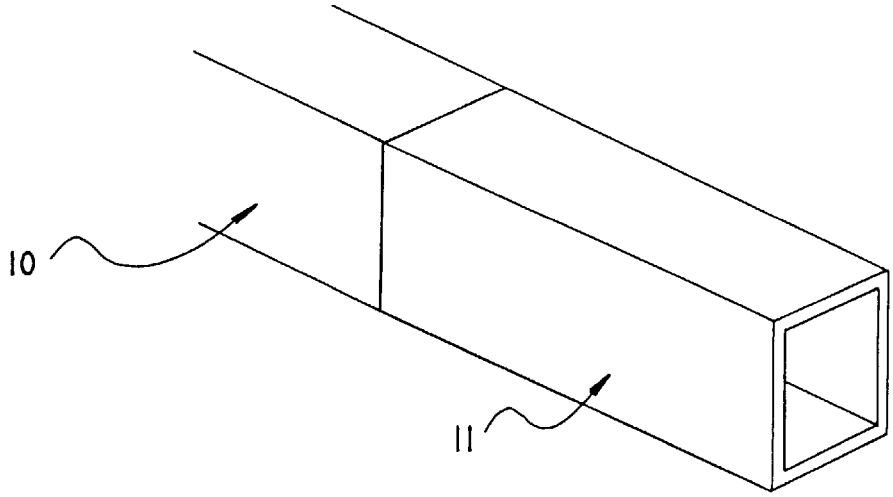
FIG. 1 is a perspective view of a hockey stick shaft made in accordance with an embodiment of the first or second aspect of the present invention.

The following discussion includes descriptions of preferred materials and method steps for making the items in accordance with the present invention, as well as features provided by the methods and products according to the present invention.

In accordance with the present invention, a laminate is formed which comprises a plurality of composite material layers, each composite material layer comprising fibers and resin.

A wide variety of materials can be used for the fibers in the composite layers used according to the present invention, those of skill in the art being familiar with many different types of fibers having various properties. In general, any fiber which provides reinforcement may be suitable for use in the present invention. For example, preferred fibers include graphite, glass and Kevlar. Examples of suitable materials include organic, inorganic and/or multiphase fibers and the fibers may be unidirectional or woven. Organic fibers include, but are not limited to, fibers made of carbon, graphite and polymers such as olefin, nylon and aramid. Inorganic fibers include, but are not limited to, fibers made of glass, metal, boron, alumina and ceramic. Multiphase fibers include, but are not limited to, fibers made of boron/tungsten, boron coated carbon and silicon carbide. The particular composite materials used will depend upon the desired characteristics of the completed hockey stick shaft such as flex, strength, durability, toughness, kickpoint, torque, weight, shock dampening, ease of manufacturing and cost.

The resin used according to the present invention can be selected from the wide variety of resins known to those skilled in the art, including but not limited to polymeric resins. It is preferred that the resin be selected such that the curing step can be conducted at or below 350° F.

Preferred examples of suitable composite materials include graphite, glass or Kevlar in either unidirectional prepreg tape or bi-directional prepreg fabric forms. An example of a suitable composite material which may be used is Newport NCT-301.

In accordance with the first and second aspects of the present invention, a plurality of composite material layers are stacked to form a laminate. Each of the layers may be similar or may differ with respect to one or more of the included materials and/or properties. During the fabrication of the laminate, plies of unidirectional tape or fabric plies may be selectively oriented in the direction that provides the cured product with the properties desired. The layers may be of similar size and shape and be stacked one on top of another, or may be of different size and shape. In addition, the stacking of the layers may be performed by using a plurality of pieces of composite material for a layer, or using only a single piece for a layer. The layers of composite material can be of any suitable thickness or thicknesses.

One way to form a laminate is to roll composite material around a mandrel having the desired shape of the finished shaft. In accordance with a preferred aspect of the present invention, the laminate can be formed by rolling composite material around the mandrel numerous times.

In general, however, the laminate can be formed in any suitable manner, and those of skill in the art are familiar with many such ways. For instance, it is possible to form a laminate by wrapping individual layers of composite material around a mandrel, wherein each layer is long enough to wrap around the mandrel at least one time, whereby the layer is placed on the mandrel with a top edge of the layer in contact with the mandrel or the outermost layer of composite material already on the mandrel, and the mandrel is then rotated until the composite material is completely wrapped around the structure, with the top edge and the bottom edge of the composite material forming a seam or seams. In the case where the composite layer is just long enough to make one revolution around the structure, a seam is formed between the top edge and the bottom edge of the composite layer. It is preferable to arrange the layers such that seams are not positioned above one another, i.e., after applying one layer, the mandrel is rotated, e.g., 180 degrees, before applying the next layer. However, in general, many different ways of applying layers of composite to form a laminate are known to those skilled in the art, and all are encompassed in the present invention.

The composite material in the laminate is brought into contact with a surface of the metallic tip. In the case where composite material is wound numerous times around a mandrel, this step can be accomplished by placing the metallic tip on the mandrel in its desired position relative to the composite material (1) prior to winding the composite material around the mandrel or (2) after winding a part of the composite around the mandrel (and before winding all of the composite material around the mandrel). In such a way, the composite material can be wrapped directly around the metallic tip (e.g., as shown in FIG. 2), or it can sandwich the metallic tip.

FIG. 1 shows a shaft including a laminate 10 and a metallic tip 11. In FIG. 1, the laminate 10 and the metallic tip 11 have axes which together form a substantially straight line, this relationship being referred to herein as coaxial. The metallic tip preferably has an outer periphery which is similar to the outer periphery of the laminate. The metallic tip can be formed of any suitable metal, with a preferred example being aluminum due to its low density (it is desirable to minimize the weight of hockey sticks). Other suitable metals include, e.g., titanium, steel alloys, and other metals which provide desired weight, mechanical properties and appearance.

Figure 2:
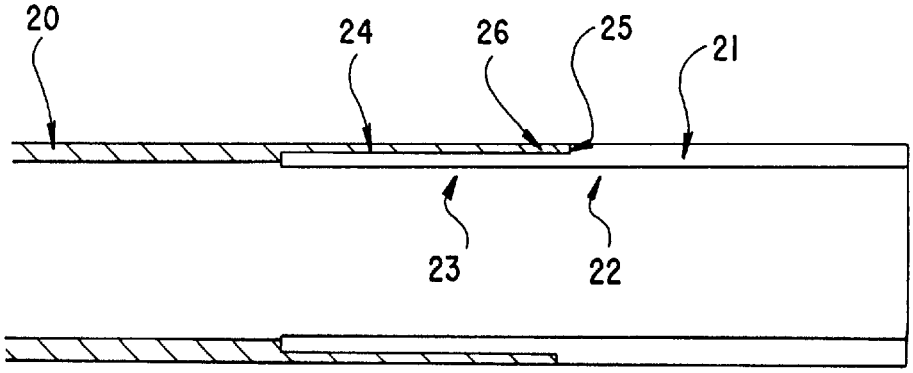
FIG. 2 is a cross-sectional view of a hockey stick shaft made in accordance with an embodiment of the first or second aspect of the present invention.

The metallic tip may have a shape which facilitates attachment to the laminate, e.g., the metallic tip may have a stepped portion as shown in FIG. 2. In FIG. 2, the metallic tip 21 has a first tip portion 22 and a second tip portion 23, the first and second tip portions being integral with each other, the second tip portion 23 having an outer surface 24 which is in contact with a part of the interior surface of the laminate, and the first tip portion 22 having a first tip surface 25 in contact with a transverse edge 26 of the laminate. The first tip surface can be oriented at any angle—in FIG. 2, the first tip surface 25 is shown substantially perpendicular to the longitudinal axis of the metallic tip 21 and the laminate 20. The metallic section may have a recessed or tapered region to facilitate the placement of polymeric materials and to minimize increased wall thicknesses or buildup. The composite material can be placed on either or both surfaces of the metallic tip to improve adhesion. FIG. 2 illustrates the composite material being added to the outside surfaces only.

In accordance with the first aspect of the present invention, the composite layer laminate and the metallic tip are co-cured, by curing the resin while the laminate and metallic tip are in contact. Prior to curing, the assembly can be wrapped with generic release coat film, if desired. In such a case, after the laminate is wrapped and placed into a vacuum bag, the bag is closed and pressure is applied to the vacuum bag such that the composite conforms to the shape of the layup mandrel, thereby forming a shaped laminate. The shaped laminate is the shape of the finished hockey stick shaft.

Curing is typically accomplished by heating. The curing can be conducted by placing the laminate and the metallic tip in a vacuum bag. The appropriate time, temperature, and pressure required to cure the resin, and thus co-consolidate the laminate and the metallic tip together depends on the nature of the resin, it being well known that different resins cure at different temperatures and pressures. Where curing is conducted in a vacuum bag, after curing, the hockey stick shaft is removed from the vacuum bag.

The metallic tip feature eliminates the possibility of thermally induced shaft damage when excessive or prolonged heat is applied to the forward blade area of the hockey stick shaft. The metallic tip provides rigidity and functions as a protective heat shield, in that it dissipates the heat energy from an open flame or heat source. Any metallic material can be used, but because of its lighter density, aluminum alloy is preferred to minimize an increase in shaft weight.

It has also been found, in accordance with the present invention, that a metalized polymeric film, or a high heat resistant (>350° F.) polymeric film could also be used to provide thermal protection to the forward blade area of the shaft. In this case, the heat resistant film is either secondarily bonded or co-cured to the outer surface of composite shaft.

In accordance with the second aspect of the present invention, the laminate and the metallic tip are attached to each other by any suitable means. For example, the laminate and the metallic tip may be attached by adhesive bonding or by the use of mechanical fasteners. The metallic tip may have a stepped portion as described above and as exemplified in FIG. 2. Alternatively, the metallic tip may be tapered. Adhesive bonding can be accomplished by applying the adhesive to the surface(s) of the laminate and/or the metallic tip which come into contact, and curing the adhesive, e.g., by applying heat and pressure, to produce a one-piece, integrated shaft. Mechanical fastening can be accomplished using rivets, screws, bolts, etc, to attach the laminate and the metallic tip.

In accordance with the third aspect of the present invention, a laminate is formed which comprises a plurality of layers of composite material and at least one metallic layer to provide a hybrid layered composite (HLC). Each of the layers of composite material can be made as described above with respect to the first and second aspects of the present invention.

The metallic layer can be made of any suitable material, e.g., the materials described above for use in making the metallic tip. The metallic layer can also be made from metallized films.

The laminate in accordance with the third aspect of the present invention can be made by a process which is similar to the lamination techniques described above with respect to the first and second aspects of the invention. During the process of making the laminate, at least one metallic layer is incorporated into the laminate. The metallic layer can be placed on the bottom (so that it will form the inner surface of the hollow article), in between composite layers, or on the top (so it will form the outer surface of the hollow article). In FIG. 4, the metallic layer 41 is the second layer from the top of the laminate. Optionally, the metallic layer may be combined with a transparent outer ply, thereby providing a unique metallic appearance to the composite shaft. The metallic layer is preferably of a thickness in the range of from about 0.001 to about 0.01 inches.

The laminate is then cured, thereby bonding the plurality of composite layers and the one or more metallic layer to each other. This step can be conducted in any manner as described above with respect to the first and second aspects of the present invention.

Similar to other composite shafts, the mechanical functionality of the HLC shaft is affected by the selection of the fiber reinforced polymeric prepreg, its gauge thickness, and the orientation of the plies. The HLC shaft is unique in that the co-consolidation of at least one metallic layer increases the thermal protection, toughness and impact damage resistance without compromising on overall strength and stiffness of the shaft. The co-consolidation technique also minimizes the potential increase in cost and weight, by eliminating secondary bonding operations that need adhesive materials to attach the metallic layer to the precured composite shaft.

In making a completed hockey stick, a stick blade is attached to a hockey stick shaft in accordance with the present invention by any suitable means for attachment, e.g, by adhesively bonding the blade to the shaft, or by mechanically attaching the blade and the shaft. It is also possible to co-cure a blade when curing or co-curing the materials in the shaft.

Figure 5:
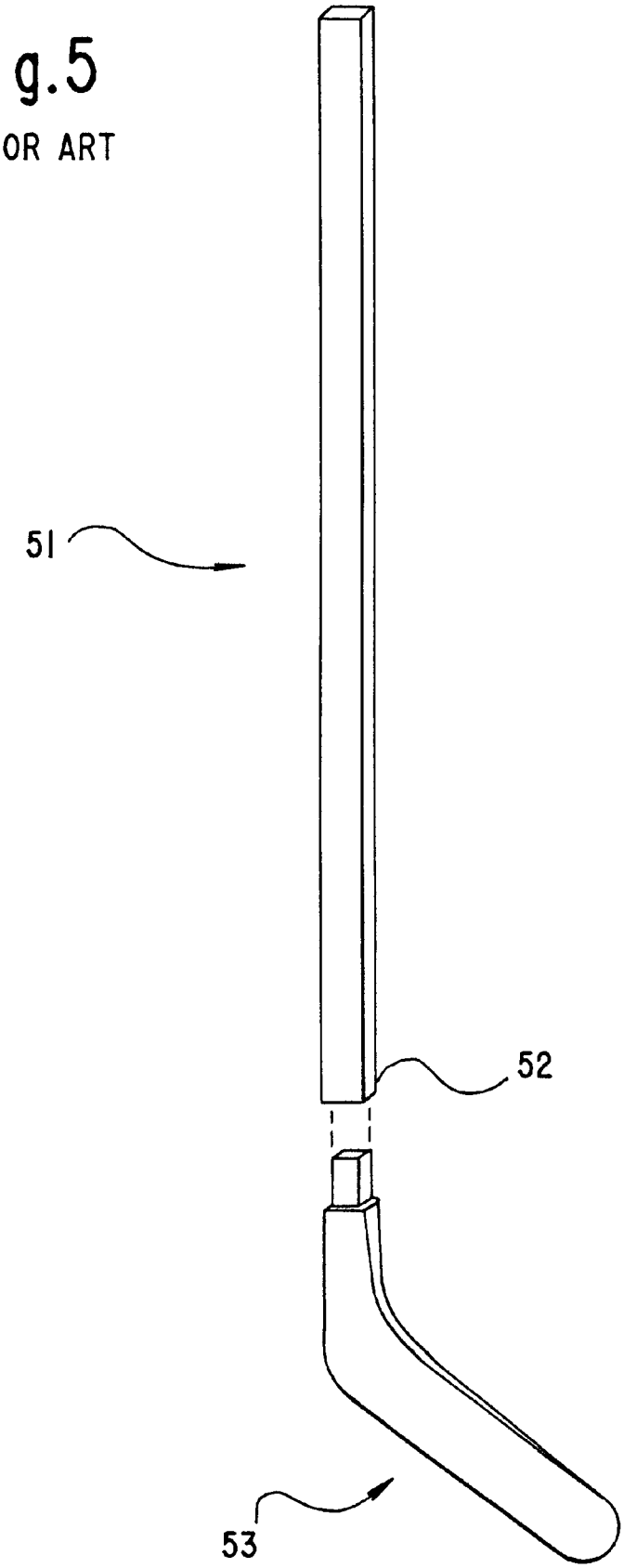
Fig.5 PRIOR ART
FIG. 5 is a perspective view of a conventional hockey stick shaft and blade.

FIG. 5 shows a conventional hockey stick, including a hockey stick shaft 51 having a blade end 52, and a blade 53 attached to the shaft 51 at the blade end 52 of the shaft.

The shape of the shaft can be any desired shape, such as rectangular, elliptical, oval, rectangular, etc. and may have rounded corners. The external dimensions of the handle portion can be made to any desirable size. The particular size and shape will depend primarily upon the desire of the user.

The hollow shaft of the hockey stick shaft may be filled with foam, such as honeycomb reinforcement fillers, closed cell high variable density foam, or other dampening or strengthening materials in order to alter the characteristics of the hockey stick shaft.

The present invention makes it possible to take advantage of the inherent property of metallic materials to resist elevated temperatures (e.g., >250° F.) without permanent deformation, and the anti-isotropic design flexibility of composite materials; it has been found, in accordance with the present invention, that a high performance, functional hockey shaft can be manufactured with both of these dissimilar materials.

The co-consolidation of a metallic alloy tip section to the blade end of a composite shaft according to the present invention provides thermal protection to the shaft when heat is used to attach or adhesively bond the blade to the stick.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A hockey stick shaft having a blade end and a remote end comprising:

a composite portion having a hollow structure, said composite portion comprising an interior surface and an exterior surface, and at least a first edge at the blade end, said composite portion comprising fibers and resin; and a metallic tip, said metallic tip having a first tip surface, said first edge of said composite portion being attached to said first tip surface of said metallic tip.

2. A hockey stick shaft as recited in claim 1, wherein said composite portion comprises said resin and a fabric made of said fibers.

3. A hockey stick shaft as recited in claim 1, wherein said fibers in said composite portion are randomly dispersed in said resin.

4. A hockey stick shaft as recited in claim 1, wherein at least a portion of said fibers are aligned in one direction.

5. A hockey stick shaft as recited in claim 1, wherein said metallic tip comprises aluminum or aluminum alloy.

6. A hockey stick shaft as recited in claim 1, wherein said first edge of said composite portion is substantially planar.

7. A hockey stick shaft as recited in claim 6, wherein said first edge of said composite portion is of an annular shape selected from the group consisting of circular, oval, elliptical, square or rectangular.

8. A hockey stick shaft as recited in claim 1, wherein said metallic tip comprises a hollow first tip portion and a hollow second tip portion, said first and second tip portions being integral with each other, said second tip portion having an outer surface, said first tip surface being located on said first tip portion adjacent to said second tip portion, said outer surface of said second tip portion being in contact with at least a first part of said composite portion.

9. A hockey stick shaft as recited in claim 8, wherein said first tip portion, said second tip portion and said composite portion each have a cross-sectional shape which is the same and which is an annular shape selected from the group consisting of circular, oval, elliptical, square and rectangular, said first tip portion, said second tip portion and said composite portion having a common longitudinal axis, said first tip surface defining a plane perpendicular to said longitudinal axis being in contact with a transverse edge of said composite portion, said first tip surface.

10. A hockey stick shaft as recited in claim 1 and a blade rigidly attached to said shaft.

* * * * *